US008963437B2

(12) United States Patent
Wu et al.

(10) Patent No.: US 8,963,437 B2
(45) Date of Patent: Feb. 24, 2015

(54) HIGH POWER DIMMER AND DIMMING SYSTEM HAVING SWITCHABLE POWER MODES, DIMMING DEVICE AND METHOD FOR TRANSMITTING POWER AND DIMMING COMMANDS

(71) Applicants: Anteya Technology Corporation, Kaohsiung (TW); Ting-Feng Wu, Kaohsiung (TW)

(72) Inventors: Ting-Feng Wu, Kaohsiung (TW); Chih-Hung Tseng, Pingtung Hsien (TW); Sheng-Chieh Tseng, Kaohsiung (TW)

(73) Assignee: Anteya Technology Corporation, Kaohsiung (TW)

( * ) Notice: Subject to any disclaimer, the term of this patent is extended or adjusted under 35 U.S.C. 154(b) by 165 days.

(21) Appl. No.: 13/785,756

(22) Filed: Mar. 5, 2013

(65) Prior Publication Data

US 2013/0234615 A1 Sep. 12, 2013

(30) Foreign Application Priority Data

Mar. 12, 2012 (TW) ..... 101108258 A

(51) Int. Cl.
*H05B 37/02* (2006.01)

(52) U.S. Cl.
CPC ..... *H05B 37/02* (2013.01); *H05B 37/0263* (2013.01)
USPC ..... 315/200 R

(58) Field of Classification Search
USPC ..... 315/200 R, 209 R, 246, DIG. 4
See application file for complete search history.

(56) References Cited

U.S. PATENT DOCUMENTS 5,483,144 A * 1/1996 Marek ..... 320/126
7,432,717 B2 * 10/2008 Frederick et al. ..... 324/414

* cited by examiner

*Primary Examiner* — Minh D A
(74) *Attorney, Agent, or Firm* — C. G. Mersereau; Nikolai & Mersereau, P.A.

(57) ABSTRACT

A dimming system is composed of a dimmer having switchable power modes and at least one lighting device. When the dimmer is in a non-dimming bypass mode, an input power is directly transmitted to the at least one lighting device with the dimmer being bypassed so that the circuit in the dimmer consumes no power. When the dimmer is in a dimming mode, an output selector of the dimmer outputs a dimming output power having a dimming command therein to each one of the at least one lighting device for each lighting device to decode the dimming command embedded in the dimming output power and perform a dimming operation according to the dimming command. As the dimming operation lasts briefly, the power consumed by the dimmer is extremely small. Accordingly, no heat dissipation issue arises and the present invention is applicable to all sorts of high power lighting devices.

18 Claims, 13 Drawing Sheets

HIGH POWER DIMMER AND DIMMING SYSTEM HAVING SWITCHABLE POWER MODES, DIMMING DEVICE AND METHOD FOR TRANSMITTING POWER AND DIMMING COMMANDS

CROSS-REFERENCE TO RELATED APPLICATIONS

This application claims the benefit of Taiwan patent application No. 101108258, filed on Mar. 12, 2012, the disclosure of which is incorporated herein in its entirety by reference.

BACKGROUND OF THE INVENTION

1. Field of the Invention

The present invention relates to a dimming control device of a lamp and more particularly to a dimmer applied to a high-power load without high heat generated and having switchable power modes.

2. Description of the Related Art

With reference to FIG. 11, a conventional dimming controller 70 connected with various lighting devices 90 is shown. Conventionally, each lighting device 90 needs to be connected to an output terminal of the dimming controller 70 through a corresponding control signal line 72 to receive a dimming command. Besides, each lighting device 90 must be connected to an input power source 76 to receive a required operating voltage through a corresponding power line 74. To dim the lighting device, a control module inside the lighting device 90 adjusts lighting luminance of the lighting device 90 according to the dimming command.

Basically, it is inconvenient to physically implement the aforementioned approach due to complicated wiring and too much time and effort involved. For instance, if tens of or even hundreds of lighting devices are mounted in a large-scale site, only the wiring work of the power lines 74 is already complicated and tremendous, not to mention enough space required to accommodate the control signal lines 72. Besides, connecting the control signal lines 72 is also another complicated task to do. When the power lines 74 are inadvertently connected with the control signal lines 72, the entire lighting system could be ruined.

The disadvantage of the conventional dimming controller 70 connected with the lighting devices in FIG. 11 is improved by incorporating the control signal lines 72 into the power lines 74 as shown in FIG. 12. The dimming controller 80 has a rectification circuit 82 and a power switch 84 therein. The rectification circuit 82 converts received AC power into full-wave DC power. The dimming controller 80 outputs the full-wave DC power through a first output terminal 801 and a second output terminal 802. The lighting devices 90 are connected in parallel between the first output terminal 801 and the second output terminal 802. The power switch 84 is connected between the second output terminal 802 and the ground in series.

To constantly convert the AC power into the full-wave DC power, the rectification circuit 82 of the dimming controller 80 needs to be always maintained at an operating state. With reference to FIG. 13(A), for sake of making a power supply loop function, a high potential is inputted to an input terminal of the power switch 84 inside the dimming controller 80 so that the power switch 84 is continuously maintained at a turn-on state and current can flow to the ground through the power switch 84. Meanwhile, the dimming controller 80 outputs the full-wave DC power as shown in FIG. 13(C). Hence, the power supply loop is formed by sequentially and serially connecting the rectification circuit 82, the lighting devices 90 and the power switch 84 and looping back to the rectification circuit 82. The power supply loop is the same as the power lines 74 in FIG. 11 in terms of the function of supplying power to the lighting devices 90. The function of the control signal lines 72 in FIG. 11 is implemented by injecting pulse signals of dimming commands as shown in FIG. 13(B) to an input terminal of the power switch 84 to rapidly turn the power switch 84 on and off, so that the full-wave DC power outputted from the rectification circuit 82 is controlled to rapidly turn on and off Such rapid turn-on and turn-off enables the full-wave DC power outputted from the rectification circuit 82 to contain pulses therein having a waveform as shown in FIG. 13(D). When the full-wave DC power is transmitted to the lighting devices 90, the lighting devices 90 further decode the dimming commands of the pulses in the full-wave DC power and perform dimming operation according to the dimming commands.

According to circuit operation, no matter whether users control the dimming controller 80 to adjust brightness of the lighting devices 90 or not, current constantly passes through the rectification circuit 82 and the power switch 84 inside the dimming controller 80 when the lighting devices 90 are normally lit. In other words, the dimming controller 80 continuously consumes power.

Consequently, the circuit in FIG. 12 is good for a light load using a small power and fails to be applicable to a high-power output. For example, under the condition that the input AC power is 110V, twenty 5 W lighting devices 90 are to be controlled, an overall power required by the lighting devices 90 is 100 W, an operating current under the 110V AC power is approximately 0.9 A, and the power switch is composed of an n-MOSFET and its turn-on resistance is 0.5Ω, then (1) a turn-on voltage of the diode of the rectification circuit 82 is 1V and the consumed power of the rectification circuit 82 is $(1V+1V)\times 0.9=1.8$ W because two diodes are on each path through which current flows; and (2) the power consumed by the n-MOSFET power switch 84 is $0.9\ A\times 0.9\ A\times 0.5\Omega=0.4$ W.

To such low-power load, the rectification circuit 82 and the power switch 84 can still be normally operated as long as heat generated therefrom is slightly dissipated.

If the original twenty 5 W lighting devices 90 are replaced by a 44 W LED grid light, the overall consumed power is 880 W, an operating power under the 110V AC power is approximately 8 A, and the power switch is composed of n-MOSFET and its turn-on resistance is 0.5Ω, then (1) the power consumed by the rectification circuit 82 is $(1V+1V)\times 8\ A=16$ W; and (2) the power consumed by the n-MOSFET power switch is $8\ A\times 8\ A\times 0.5\Omega=32$ W.

To such high power load, besides a large-scale heat sink, a fan is also needed to achieve the intended heat-dissipating effect. Up to here, commercial value and feasibility of such product has already gone.

Moreover, when the rectification circuit 82 is operated above 100° C., the rated current thereof starts dropping. For example, the rated current may drop to 5 A from the original 10 A. The lower withstand current rating may lead to direct burn-out of the rectification circuit 82.

SUMMARY OF THE INVENTION

A first objective of the present invention is to provide a high power dimmer having switchable power modes activated only when performing a dimming adjustment and directly taking the bypass and transmitting power to lighting device connected with the dimmer when staying at a non-dimming mode to lower power consumed by the dimmer itself.

To achieve the foregoing objective, the high power dimmer having switchable power modes has a power input terminal, a rectification circuit, a dimming controller, a power switch, an output selector and a power and signal output terminal.

The power input terminal receives an AC power.

The rectification circuit is connected to the power input terminal for rectifying the AC power under a dimming mode to generate an output power.

The dimming controller outputs a switching command and a dimming command under the dimming mode.

The power switch is normally on and is turned on and off according to the dimming command to convert the output power into a dimming output power having the dimming embedded therein.

The output selector has a first input port, a second input port and an output port.

The first input port is connected to the power input terminal to receive the AC power.

The second input port is connected to the power switch to receive the dimming output power.

The output port is selectively connected to the first input port or the second input port according to the switching command generated by the dimming controller.

The power and signal output terminal is connected to the output port of the output selector to output the AC power or the dimming output power.

Given the foregoing circuit design, the high power dimmer allows current to flow through the rectification circuit and control the power switch to turn on and off in generation of a dimming output power and the output port of the output selector is connected to the second input port only when the dimmer performs a dimming adjustment. Thus, the dimmer sends out the dimming output power containing a dimming command therein.

When the dimmer performs no dimming adjustment, the output port of the output selector is connected to the first output port and the AC power is directly transmitted to the lighting device with the dimmer being bypassed, thereby consuming no power as the rectification circuit and the power switch are bypassed. Practically, as the time for performing a dimming adjustment is very short, the dimmer consumes very little power and no heat dissipation issue arises accordingly. Moreover, since the input power is transmitted to the lighting devices with the dimmer being bypassed, even high power lighting devices introduce no over-heated issue to the dimmer.

A second objective of the present invention is to provide a dimming system having switchable power modes.

To achieve the foregoing objective, the dimming system having switchable power modes has the foregoing high power dimmer and at least one lighting device. Each one of the at least one lighting device has a dimmable power source and at least one lighting unit.

The dimmable power source has a power and signal input terminal, a power supply, a light source driving circuit, a dimming decoder and a control circuit.

The power and signal input terminal is connected to the power and signal output terminal of the dimmer to receive the AC power or the dimming output power outputted from the dimmer.

The power supply receives the AC power or the dimming output power through the power and signal input terminal to generate a DC power supplying the lighting device.

The light source driving circuit is connected to the power supply to receive the DC power and further drive the lighting unit to emit light.

The dimming decoder receives the dimming output power through the power and signal input terminal, fetches a dimming signal portion in the dimming output power, and decodes the dimming signal portion to the original dimming command.

The control circuit generates a control signal according to the dimming command and sends the control signal to the light source driving circuit for the light source driving circuit to drive the lighting unit to present specific lighting variations.

In the foregoing dimming system, when the dimmer performs no dimming adjustment, the AC power is directly transmitted to the lighting devices with the dimmer being bypassed. The power supply in the lighting device converts the AC power into a DC power. As the lighting device provides normal lighting according to an original dimming command and the dimmer is only responsible for the bypassed transmission of the AC power, the dimmer consumes extremely low power and causes no heat dissipation issue.

When the dimmer performs a dimming adjustment, the rectification circuit therein is activated to control the power switch to turn on and off in generation of a dimming output power, and the output port of the output selector outputs the dimming output power having a dimming command to each lighting device. The lighting device then decodes a dimming command used as a basis of subsequent lighting.

A third objective of the present invention is to provide a dimming device having the foregoing high power dimmer and a dimmable power source. The dimmable power source has a power and signal input terminal, a power supply, a light source driving circuit, a dimming decoder and a control circuit.

The power and signal input terminal is connected to the power and signal output terminal of the dimmer to receive the AC power or the dimming output power outputted from the dimmer.

The power supply receives the AC power or the dimming output power through the power and signal input terminal to generate a DC power supplying the lighting device.

The light source driving circuit is connected to the power supply to receive the DC power and further drive the lighting unit.

The dimming decoder receives the dimming output power through the power and signal input terminal, fetches a dimming signal portion in the dimming output power, and decodes the dimming signal portion to the original dimming command.

The control circuit generates a control signal according to the dimming command and sends the control signal to the light source driving circuit for the light source driving circuit to adjust a driving current.

Given a dimming device composed of the high power dimmer and the dimmable power source, the dimming device can be applied to control a lighting mode and luminance required by a lighting device, such as light-emitting diode (LED), organic light-emitting diode (OLED) or polymer light-emitting diode (PLED).

A fourth objective of the present invention is to provide a method for transmitting power and dimming commands performed by a dimmer having switchable power modes and multiple lighting devices electrically connected therewith, and the method has the following steps.

The dimmer determines if receiving a user command to perform a dimming adjustment.

If the dimmer is not instructed to perform a dimming adjustment, the dimmer performs a bypass mode when an AC power is directly transmitted to the lighting devices with the dimmer being bypassed.

If the dimmer is instructed to perform a dimming adjustment, the dimmer performs a dimming mode when the dimmer further performs steps of:

converting the AC power into a full-wave DC power;

modulating the full-wave DC power by turning on and off the full-wave DC power according to pulses of a dimming command so as to generate a dimming output power having the pulses of the dimming command embedded therein; and transmitting the dimming output power to the lighting devices for the lighting devices to decode the dimming command and receive a required power and performing the dimming adjustment according to the decoded dimming command.

Other objectives, advantages and novel features of the invention will become more apparent from the following detailed description when taken in conjunction with the accompanying drawings.

DETAILED DESCRIPTION OF THE INVENTION

Figure 1:
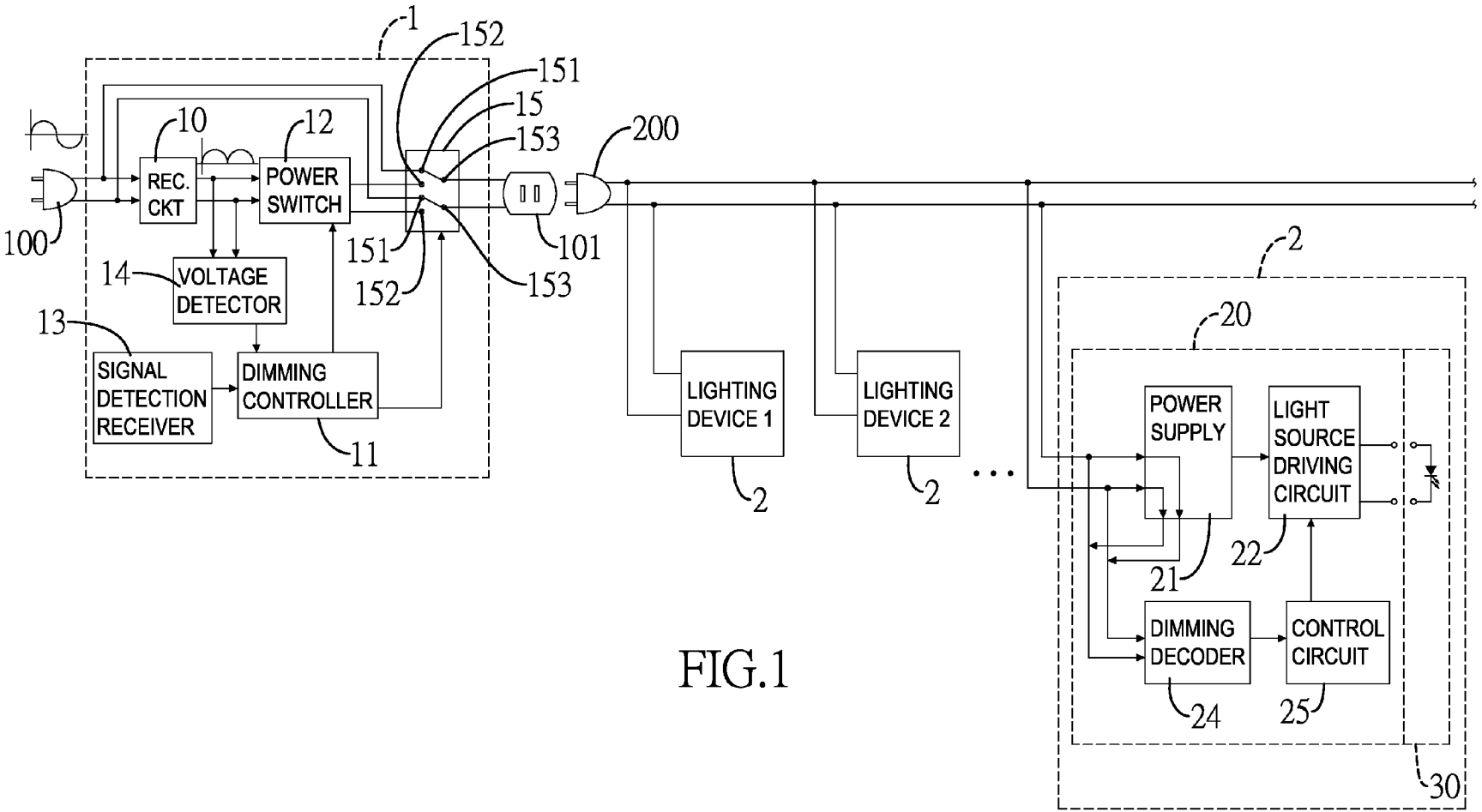
FIG. 1 is a functional block diagram of a dimmer having switchable power modes and connected with multiple lighting devices in accordance with the present invention.
Figure 2:
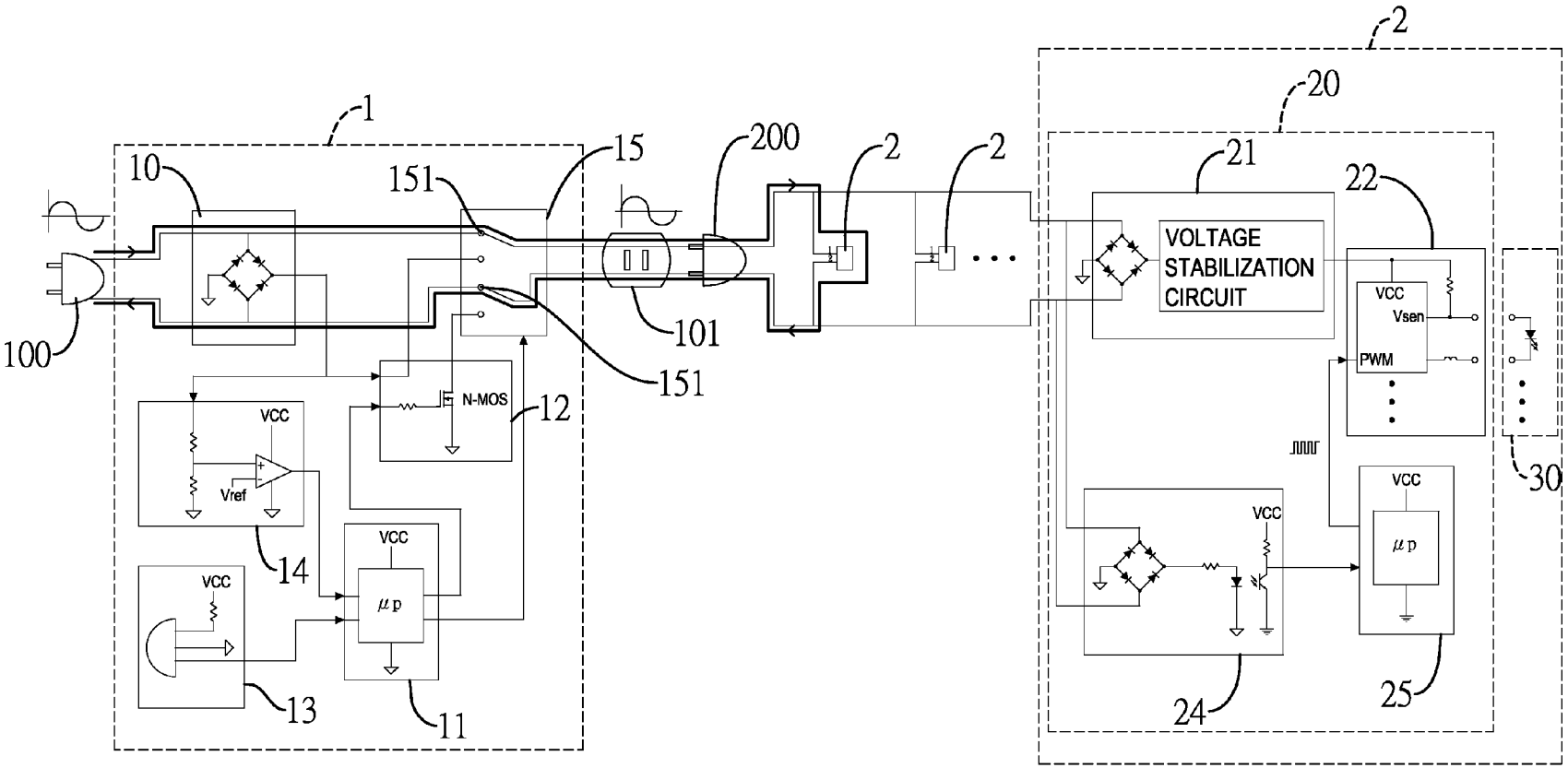
FIG. 2 is a circuit diagram of the dimmer and the lighting devices in FIG. 1 adopting an n-MOSFET power switch and setting an output selector to a bypass mode.

With reference to FIGS. 1 and 2, a dimmer 1 electrically connected to multiple lighting devices 2 in accordance with the present invention has a power input terminal 100, a rectification circuit 10, a dimming controller 11, a power switch 12, a signal detection receiver 13, a voltage detector 14, an output selector 15 and a power and signal output terminal 101.

The power input terminal 100 is connected to an AC power source and a waveform of the AC power source is shown in FIG. 3(A).

The rectification circuit 10 is a bridge rectifier connected to the power input terminal 100, and rectifying and outputting the AC power. If the AC power source is a regular mains power, an output waveform of the rectified power taking a continuous positive half wave form and named as a full-wave DC power is shown in FIGS. 3(B) and 5(B).

The dimming controller 11 is a microprocessor capable of outputting a dimming command. The dimming command is a pulse train having a waveform as shown in FIG. 5(D). The format of the dimming command may be a common UART (universal asynchronous receiver transmitter) format or a self-defined pulse train format, such as a PTM (pulse time modulation) format defining wide pulses as 1 and narrow pulses as 0 so as to send out digital signals having bits of 1 and 0 in accordance with widths of the pulses. The dimming controller 11 is embedded with preset dimming commands corresponding to specific lighting modes. For example, different lighting modes are set up at different times of the day. When a specifically set time expires, the dimmer 1 automatically outputs a dimming command corresponding to the specific time to achieve automatic luminance adjustment, such as a lighting mode with higher luminance in the dusk or nighttime or a lighting mode with lower luminance in the daytime. In the present embodiment, the dimming controller 11 is further connected to a signal detection receiver 13 and generates a corresponding dimming command according to an external dimming signal received by the signal detection receiver 13 and inputted by users.

The signal detection receiver 13 serves to receive an external dimming signal for the dimming controller 11 to encode dimming commands according to the dimming signal. Based on the external dimming signal, the dimming controller 11 can generate dimming commands with different dimming modes. The signal detection receiver 13 may be selected from one of an IrDA (Infrared Data Association) infrared receiver, RF (Radio frequency) receiver, PIR (Passive infrared)-based motion sensor, audio receiver, RS485 receiver, DMX512 receiver, RS232 receiver, PLC (Power line communication) receiver, keyboard/keypad receiver and VR (Variable resistor) receiver. According to a specific type of the signal detection receiver 13, users can transmit external dimming commands to the signal detection receiver 13 via a corresponding user interface controller, such as an IrDA infrared remote control, RF remote control, Audio control, RS232/RS485/PLC interface and computer, or DMX512 controller. With reference to FIGS. 2, 4, 6 and 7, the circuit associated with the signal detection receiver 13 is based on the use of an IrDA infrared receiver. Hence, users can adjust luminance with the dimmer 1 using an IrDA infrared remote control.

The voltage detector 14 is connected between the rectification circuit 10 and the dimming controller 11 and is preset with a reference voltage. An input terminal of the voltage detector 14 is connected to an output terminal of the rectification circuit 10 to compare the rectified output voltage of the rectification circuit 10 with the reference voltage. With reference to FIGS. 3(C) and 5(C), the comparison result is outputted to the dimming controller 11. Suppose that the peak voltage is 155V under a 110V mains power and the reference voltage of the voltage detector 14 is 100V, the voltage detector 14 outputs 1 when the rectified output voltage is greater than 100V and outputs 0 when less than 100V. With reference to FIG. 5(B), the voltage of the curve rises from 0V to 100V, which is a starting point of a high voltage region Z, and further up to the peak voltage, 155V, and then drops to 100V and leaves the high voltage region Z. The voltage detector 14 informs the dimming controller 11 of a message within the high voltage region Z for the dimming controller 11 to send a dimming command within the high voltage region Z. If a dimming command is not issued within the high voltage region Z, the dimming command may fail because a rectified output voltage 0V, such as the y point in FIG. 5(B), may be encountered if not within the high voltage zone Z. The dimming signal sent out by the dimming controller 11 at this moment fails to be reflected at an output terminal of the dimming controller 11 and is therefore lost. The voltage detector 14 targets at ensuring that dimming signals are successfully sent out. To save cost, the voltage detector 14 may be ignored since the dimming controller 11 can avoid sending a dimming signal around a region in the proximity of a y point (100V to 0V or 0V to 100V) as shown in FIG. 5(B) and send more dimming signals to increase a success rate of the dimming signals.

Figure 4:
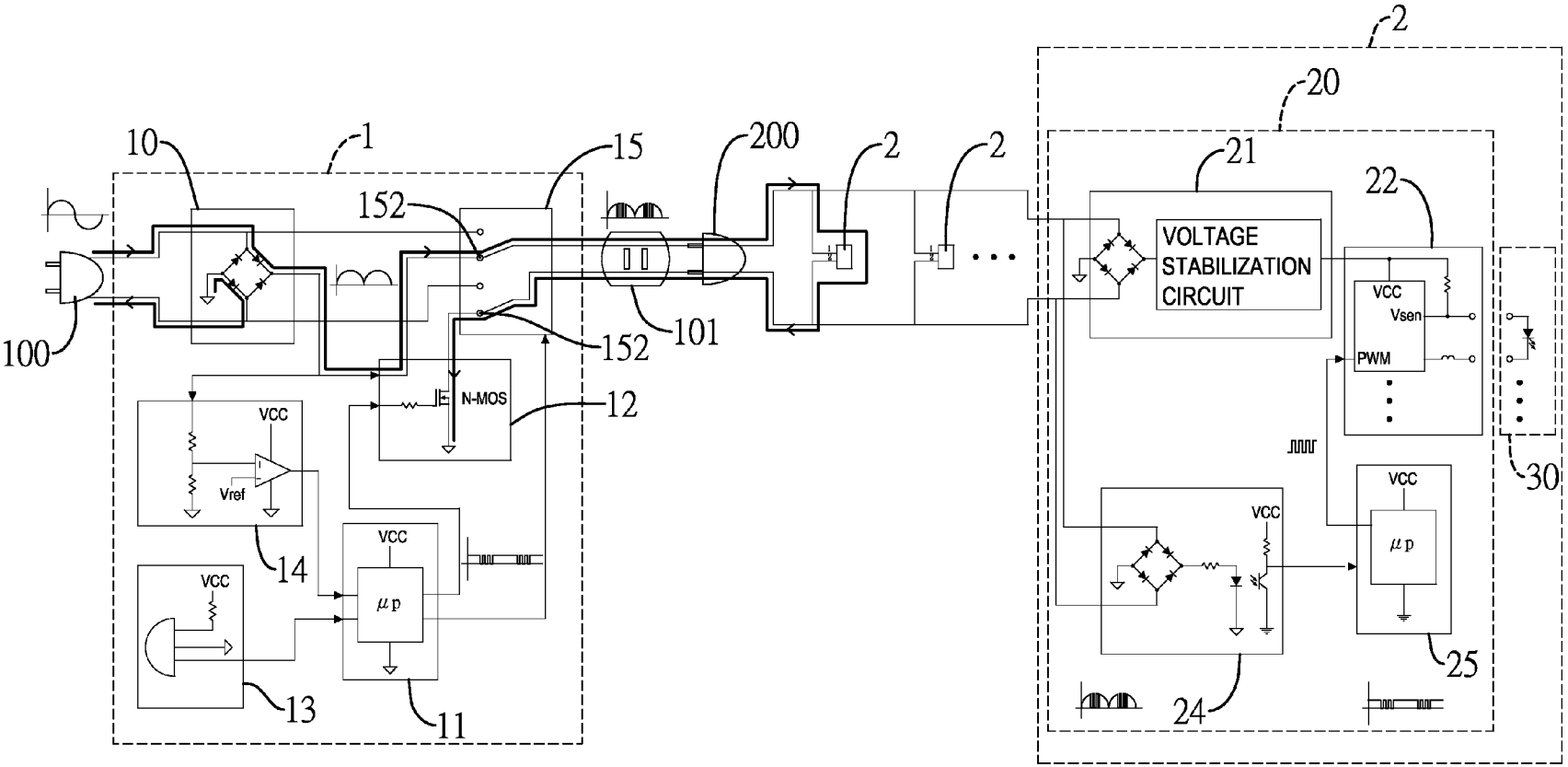
FIG. 4 is a circuit diagram of the dimmer and the lighting devices in FIG. 1 adopting an n-MOSFET power switch and setting an output selector to a dimming mode.
Figure 6:
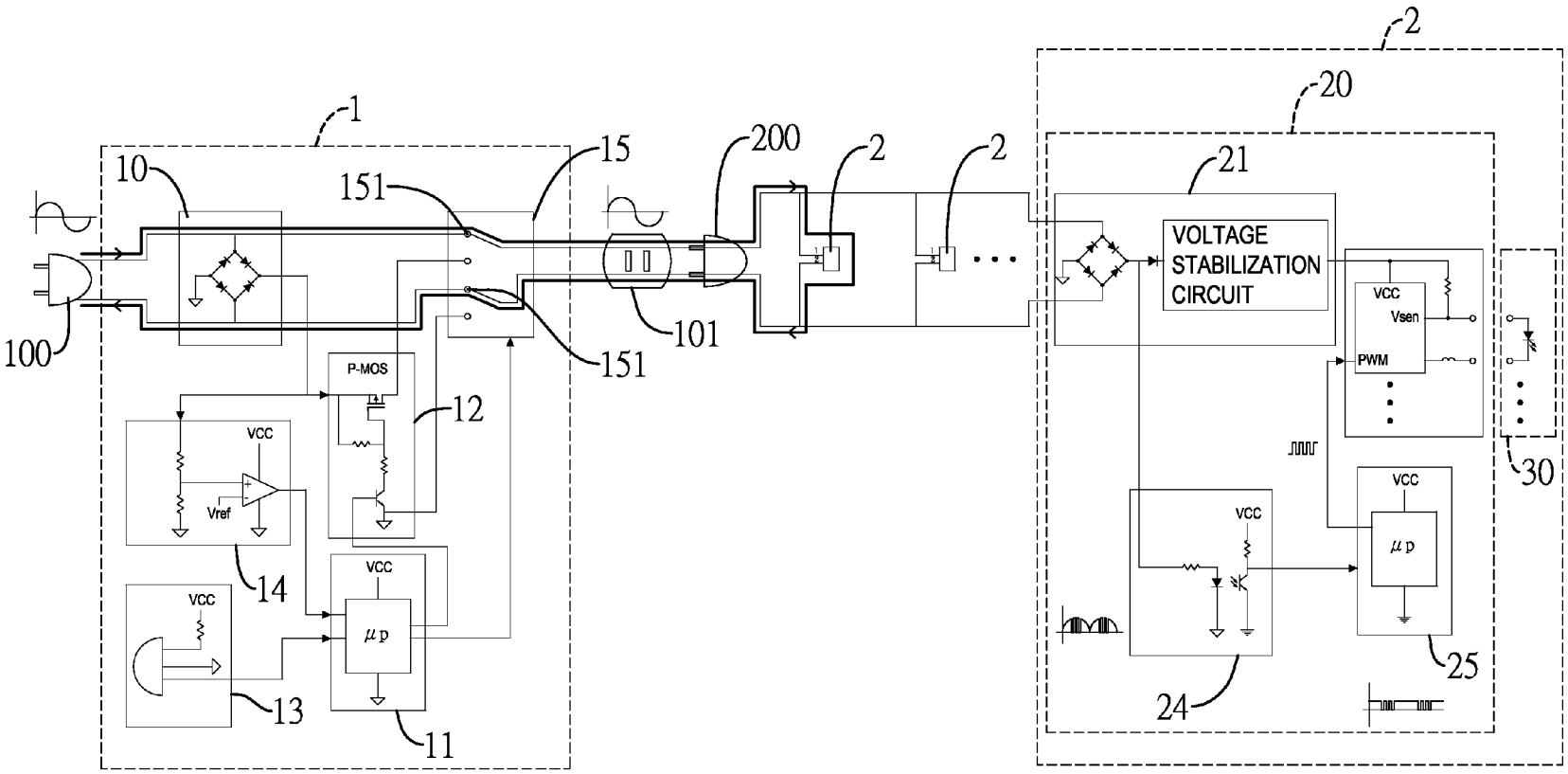
FIG. 6 is a circuit diagram of the dimmer and the lighting devices in FIG. 1 adopting a p-MOSFET power switch and setting an output selector to a bypass mode.
Figure 7:
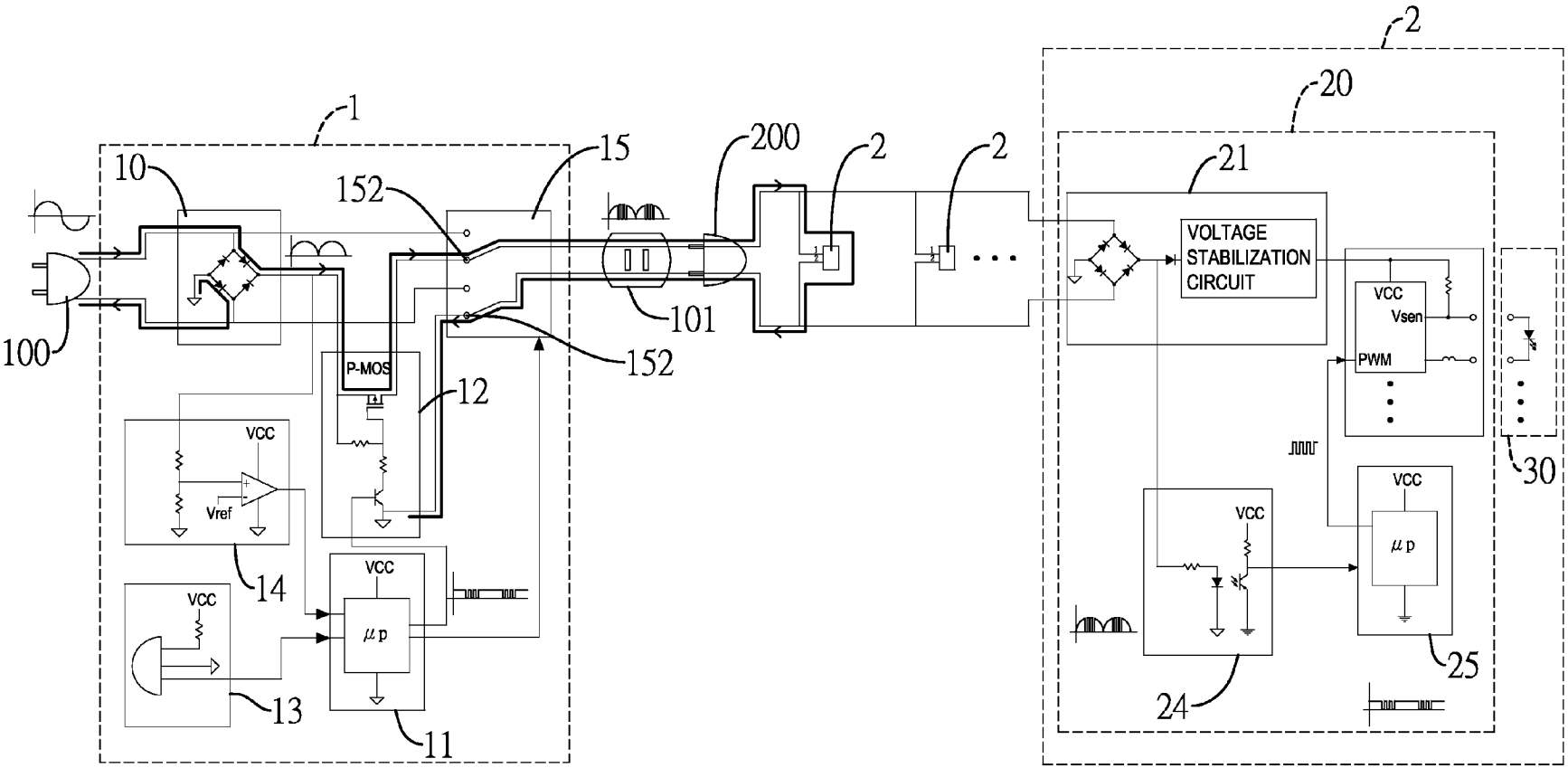
FIG. 7 is a circuit diagram of the dimmer and the lighting devices in FIG. 1 adopting a p-MOSFET power switch and setting an output selector to a dimming mode.

The power switch 12 is connected to the dimming controller 11 and the rectification circuit 10. The power switch 12 is normally on and is turned on and off only when receiving a dimming command to control the rectification circuit 10 to alternately turn on and off according to the dimming command. The output power of the rectification circuit 10 becomes a dimming output power having a dimming command therein and its waveform is shown in FIG. 5(E). The power switch 12 has a switch therein and the switch may be selected from one of solid state relay, p-MOS FET, n-MOSFET, NPN transistor, PNP transistor, IGBT, SCR and TRIAC. The switch in FIGS. 2 and 4 is an n-MOSFET while the switch in FIGS. 6 and 7 is a p-MOSFET.

The output selector 15 has a first input port 151, a second input port 152 and an output port 153. The first input port 151 is directly connected to the power input terminal 100 to receive the AC power. The second input port 152 is connected to the power switch 12 to receive the dimming output power having the dimming signal therein. The output port 153 is selectively connected to the first input port 151 or the second input port 152 according to a switching command generated by the dimming controller 11.

The power and signal output terminal 101 is connected to the output port 153 of the output selector 15 to output the AC power or the dimming output power having the dimming signal therein. With reference to FIGS. 1, 2, 4, 6 and 7, connection interfaces of the power and signal output terminal 101 and the power input terminal 100 pertain to a socket adapter. However, the foregoing connection interfaces may also include wire-out type and power terminal type connection interfaces and the like.

Each lighting device 2 connected to the dimmer 1 has a dimmable power source 20 and at least one lighting unit 30. The dimmable power source 20 has a power and signal input terminal 200, a power supply 21, a light source driving circuit 22, a dimming decoder 24 and a control circuit 25.

The power and signal input terminal 200 is connected to the power and signal output terminal 101 of the dimmer 1.

The power supply 21 receives the AC power or the dimming output power through the power and signal input terminal 200 to generate a DC power supplying the lighting device 2. The power supply 21 may be composed of a bridge rectifier and a voltage stabilization circuit.

The light source driving circuit 22 is connected to the power supply 21 to receive the DC power and further output a driving current to the lighting unit 30.

The dimming decoder 24 receives the dimming output power through the power and signal input terminal 200, fetches the dimming signal in the dimming output power, and recovers to an original dimming command. With reference to FIG. 2, a first embodiment of the dimming decoder 24 in accordance with the present invention is directly connected to the power and signal input terminal 200 and has a bridge rectifier, a current limiting resistor and an optocoupler. The bridge rectifier serves to ensure that power enters the optocoupler with correct polarities after the power passes through the bridge rectifier no matter whether the power and signal input terminal has correct or reverse polarity. With reference to FIG. 7, a second embodiment of the dimming decoder 24 in accordance with the present invention requires no bridge rectifier therein as the dimming decoder 24 can share the bridge rectifier of the power supply 21.

An input terminal of the control circuit 25 is connected to the dimming decoder 24, and an output terminal is connected to the light source driving circuit 22. The control circuit 25 receives and records a dimming command decoded by the dimming decoder 24 and generates a control signal according to the dimming command and sends the control signal to the light source driving circuit 22 so that the light source driving circuit 22 can drive the lighting unit 30 to present specific luminance or lighting variations. Therefore, the lighting unit 30 not only possesses luminance presentation but also versatile variation effects in accordance with the dimming signal. Furthermore, the control circuit 25 has a flash memory for recording a lighting condition of the lighting unit 30 and an address of the pertaining lighting device 2.

The lighting unit 30 is connected to and driven by the light source driving circuit 22 to emit light. The lighting unit 30 may be composed of at least one light-emitting diode (LED), at least one organic light-emitting diode (OLED) or at least one polymer light-emitting diode (PLED) to emit chromatic light having different wavelengths, such as light having three primary colors (red, green and blue) or mixed colors of the primary colors, or a combination of blue phosphor and yellow phosphor to emit white light.

The circuit operation of the present invention can be classified as a bypass mode and a dimming mode depending on if the dimmer 1 is activated. The detailed operation of the two modes is described as follows.

A. Bypass Mode

Figure 3:
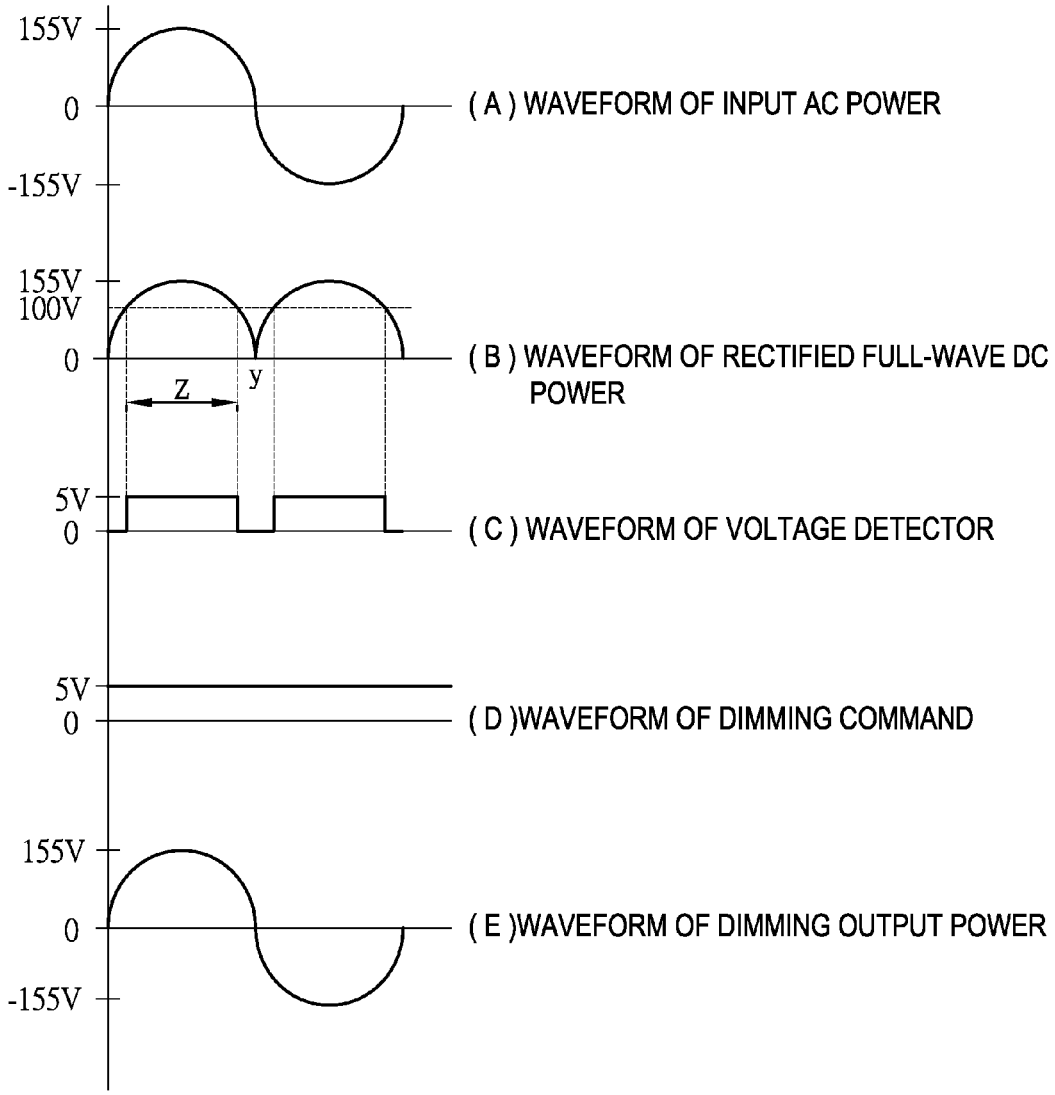
FIGS. 3(A)-3(E) are waveform diagrams corresponding to inputs and outputs of the circuit in FIG. 2.

With reference to FIGS. 2 and 3, when users perform no dimming adjustment to the dimmer 1, the dimmer 1 is in the bypass mode. The output port 153 of the output selector 15 is connected to the first input port 151. The AC power passes through the output selector 15 from the power input terminal 100 and is bypassed and transmitted to the power and signal output terminal 101. A current-flowing path is illustrated by thick solid lines in FIG. 2. As the rectification circuit 10 is not activated, the power switch 12 has no current passing through and hardly consumes any power.

Each lighting device 2 receives the AC power through the power and signal input terminal 200, converts the AC power into DC power using the power supply 21 therein, and supplies the DC power to the light source driving circuit 22. The control circuit 25 controls the light source driving circuit 22 according to an original lighting condition stored therein for the lighting unit 30 to generate a corresponding luminance or lighting mode.

During the bypass mode, as each lighting device 2 provides normal lighting based on a preset dimming command and the dimmer 1 is just responsible for bypass transmission of the AC power, the rectification circuit 10 and the power switch 12 hardly consume any power.

Similarly, when the power switch 12 adopts a p-MOSFET, the current-flowing path during the bypass mode is shown in FIG. 6.

B. Dimming Mode

Figure 5:
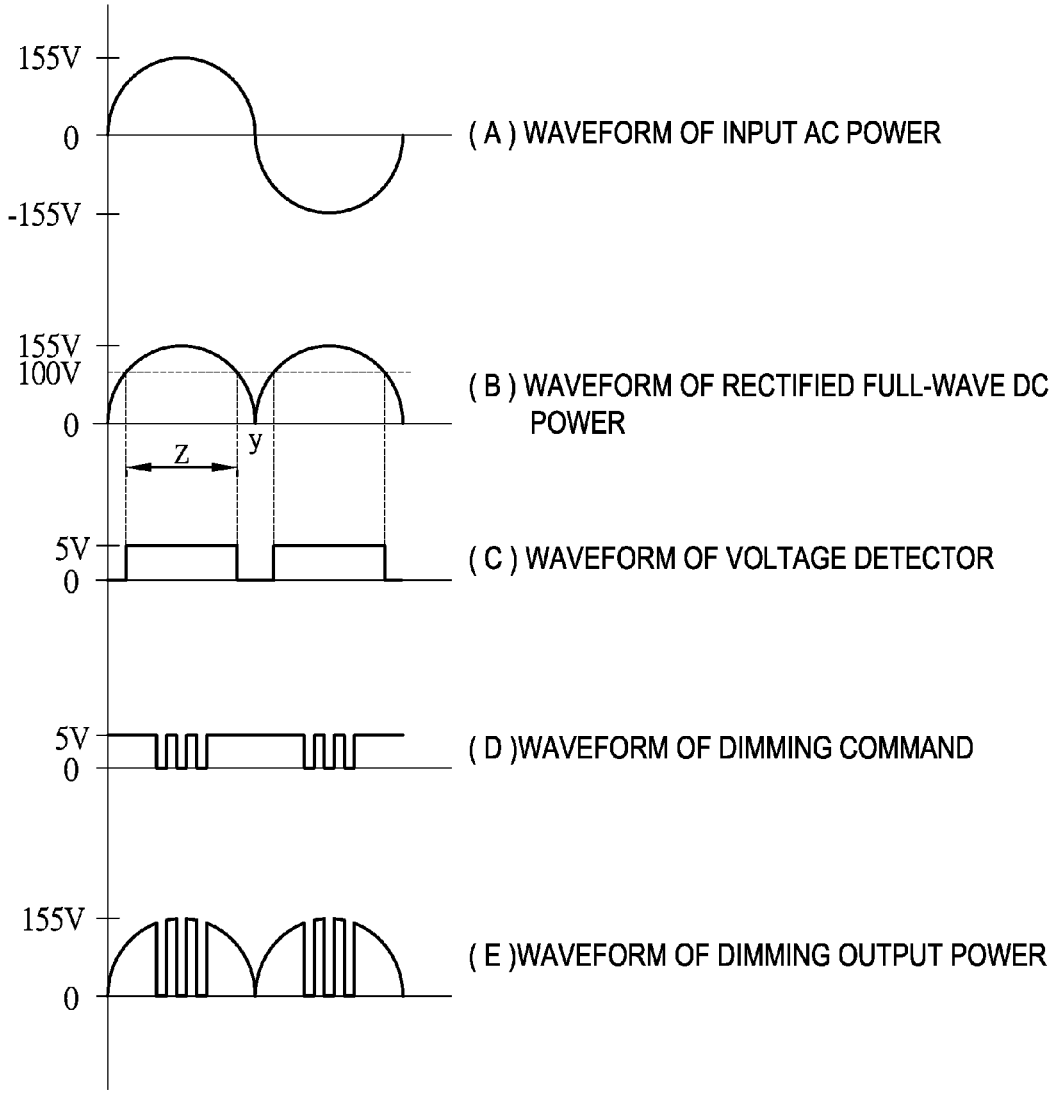
FIGS. 5(A)-5(E) are waveform diagrams corresponding to inputs and outputs of the circuit in FIG. 4.

With reference to FIGS. 4 and 5, when users intend to change luminance or lighting mode of each lighting device 2, an external dimming signal is outputted through a user interface controller to the signal detection receiver 13 and further to the dimming controller 11 through the signal detection receiver 13. The dimming controller 11 outputs a switching command to control the output port 153 of the output selector 15 to switch to the second output port 152. Meanwhile, the dimming controller 11 generates a dimming command to control the switch in the power switch 12 to turn on and off. The output selector 15 sends out the dimming output power containing a dimming command therein to the power and signal output terminal 101 and further to the lighting device 2 through the power and signal input terminal 200. The waveform of the dimming output power is shown in FIG. 5(E).

After the lighting device 2 receives the dimming output power, the dimming decoder 24 decodes the dimming command contained in the dimming output power and the dimming command is sent to the control circuit 25. The control circuit 25 then stores the dimming command and drives the light source driving circuit 22 with the dimming command for the lighting unit 30 to generate a corresponding luminance or lighting mode.

After the dimming command is transmitted, a switching command issued from the dimming controller 11 instructs the output port 153 of the output selector 15 to switch to the first input port 151.

Similarly, when the power switch 12 adopts a p-MOSFET, the current-flowing path during the dimming mode is shown in FIG. 7.

Since the dimming controller 11 is stored with multiple dimming commands configured for different schedules, the present invention can automatically generate dimming commands upon configured schedules without having to receive users' adjustment commands through the signal detection receiver 13.

The foregoing circuit operation points out that the present invention only needs to let current flow through the rectification circuit 10 and turns on the switch in the power switch when it is necessary to adjust a lighting condition. When it is unnecessary to adjust a lighting condition, the AC power is bypassed and transmitted to the lighting devices 2 and there is no additional power consumption as no current flows through the rectification circuit 10 and the power switch 12.

The time required to perform dimming adjustment is very short. Suppose that ten dimming adjustments are needed in a day and each dimming adjustment lasts about 0.1 second, total ten dimming adjustments require just one second. One second out of 86,400 seconds in a day is spent for dimming adjustment while the rest of 86,399 seconds are consumed in the non-dimming modes. The over-heated issue of the rectification circuit 10 and the power switch 12 certainly will not happen. Accordingly, the present invention significantly enhances the heat-dissipating capability of the conventional dimmers and also increases the wattage output of dimmers.

Figure 8:
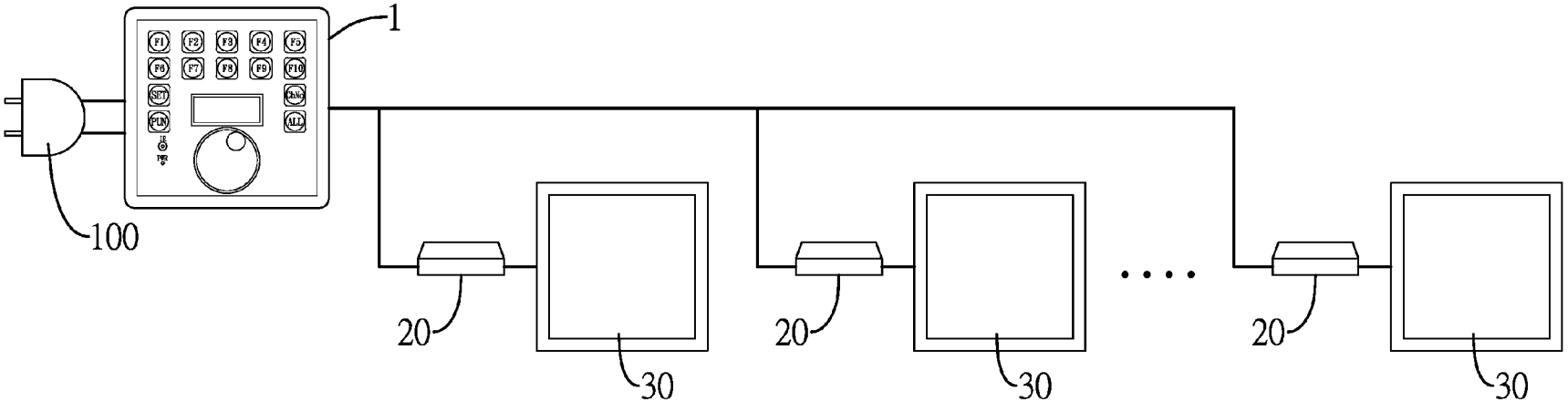
FIG. 8 is a schematic view of a lighting system composed of the dimmer having switchable power modes and multiple flat panel lighting devices in accordance with the present invention.
Figure 9:
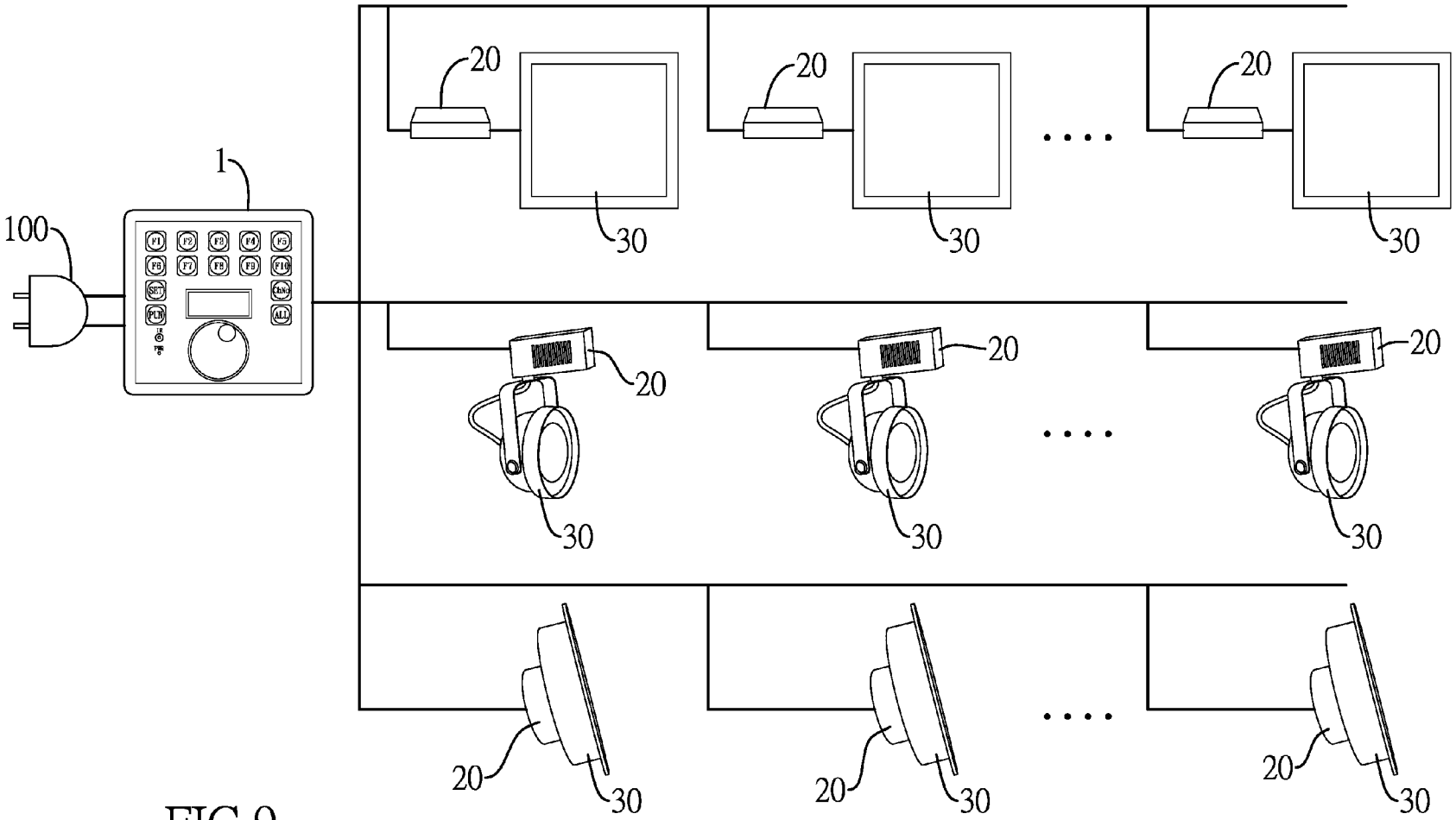
FIG. 9 is a schematic view of a lighting system composed of the dimmer having switchable power modes and various lighting devices in accordance with the present invention.

With reference to FIGS. 8 and 9, the lighting devices 2 have no special limitation in terms of their types, such as grid light, incandescent light bulb, projection lamp and the like. Each type of lighting devices has its compatible socket adapter, such as one of socket type, wire-out type and power terminal type connection interfaces and adapter types of E27, E12, E14, E17, E26, E39, E40, MR11, MR16, GU10, B22, T5, T8, GU24 and the like.

Additionally, the high power dimmer 1 and the dimmable power source 20 can be combined into a dimming device, which is applied to control the lighting units, such as a lighting unit constituting an LED device, to generate required lighting modes and luminance, and to inherit the advantage of the high power dimmer in terms of low power consumption.

Figure 10:
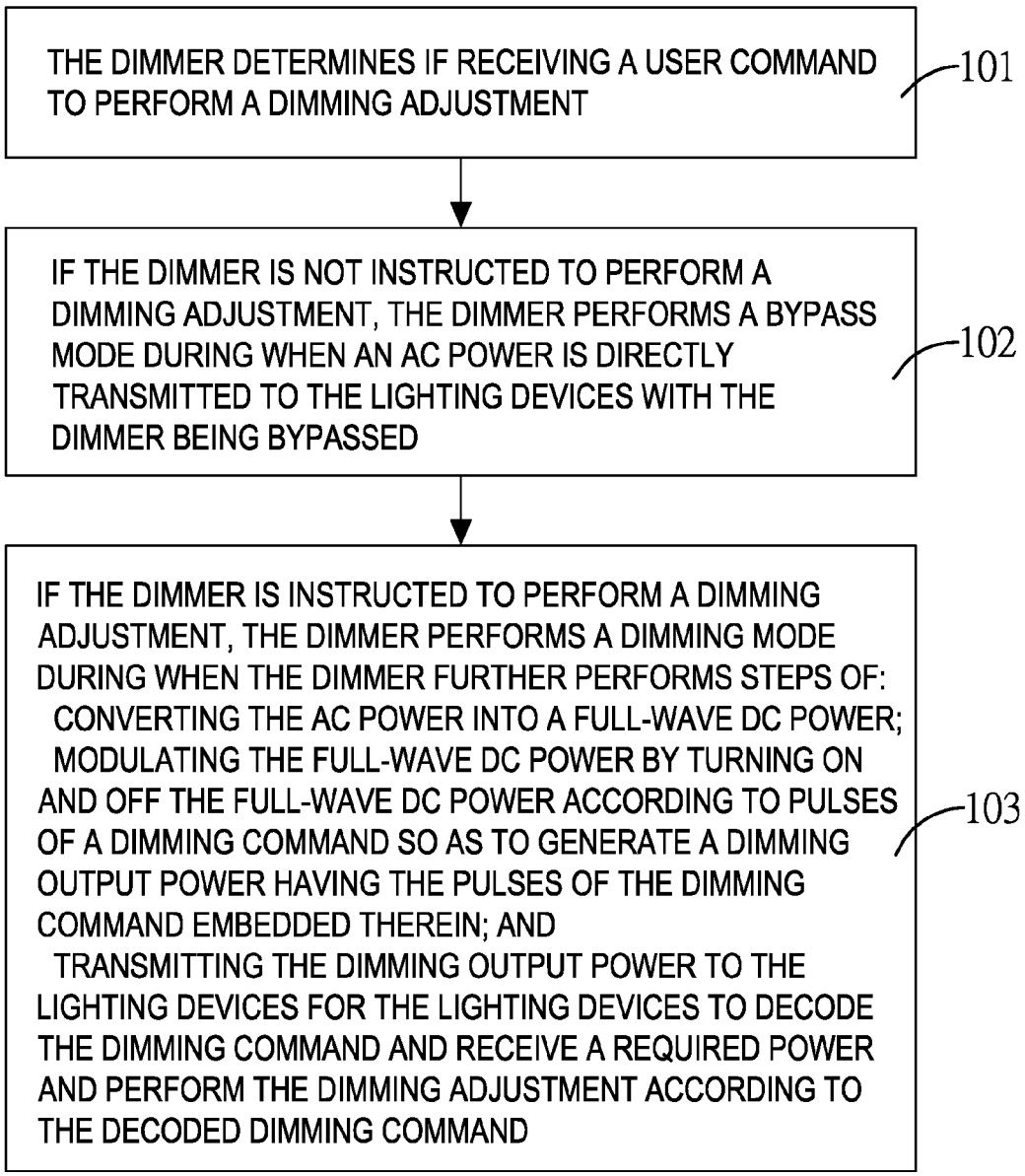
FIG.10 PRIOR ART
FIG. 10 is a flow diagram of a method for transmitting power and dimming commands in accordance with the present invention.
Figure 11:
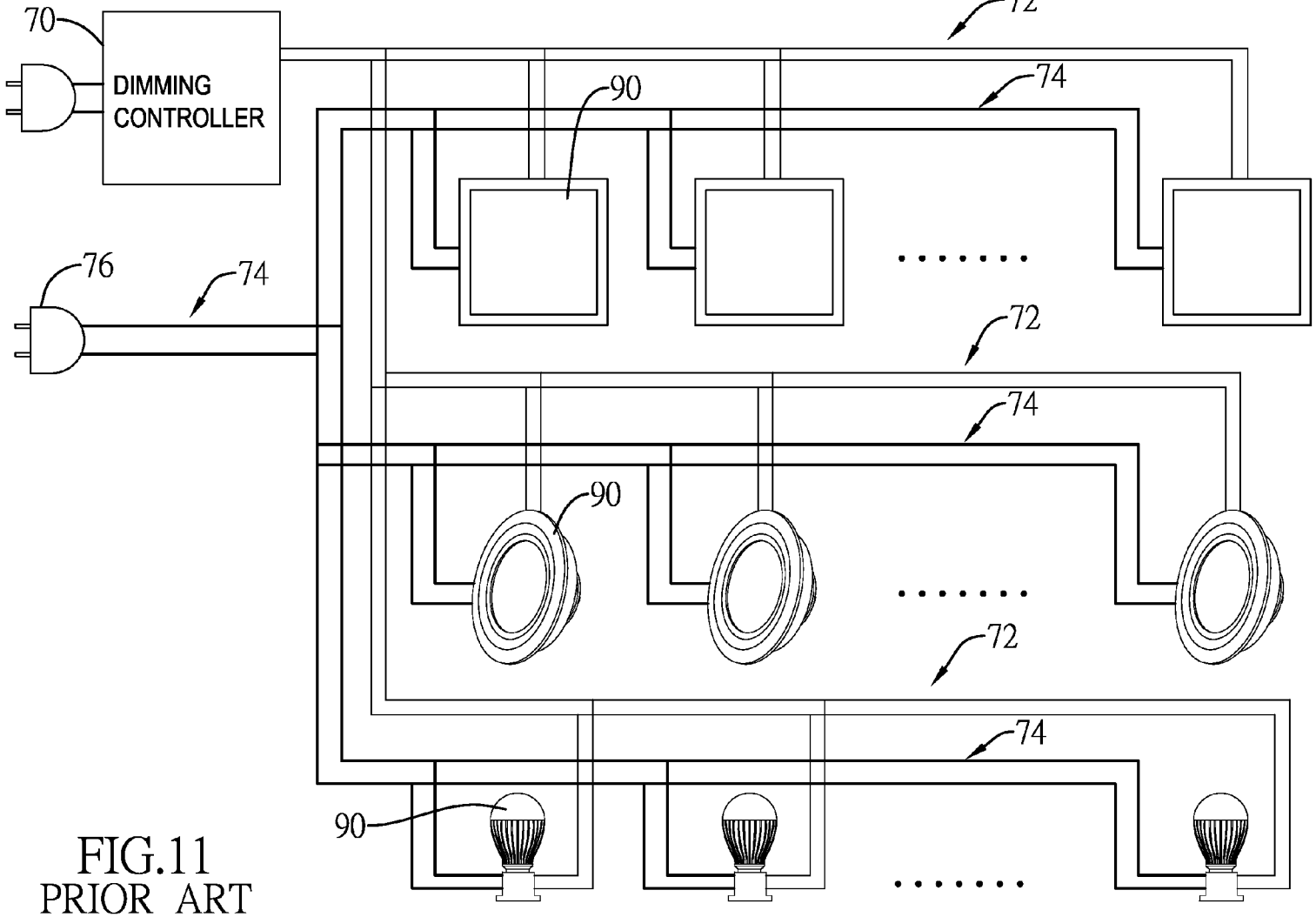
FIG.11 PRIOR ART
FIG. 11 is a schematic view of a conventional dimming controller connected with various lighting devices.
Figure 12:
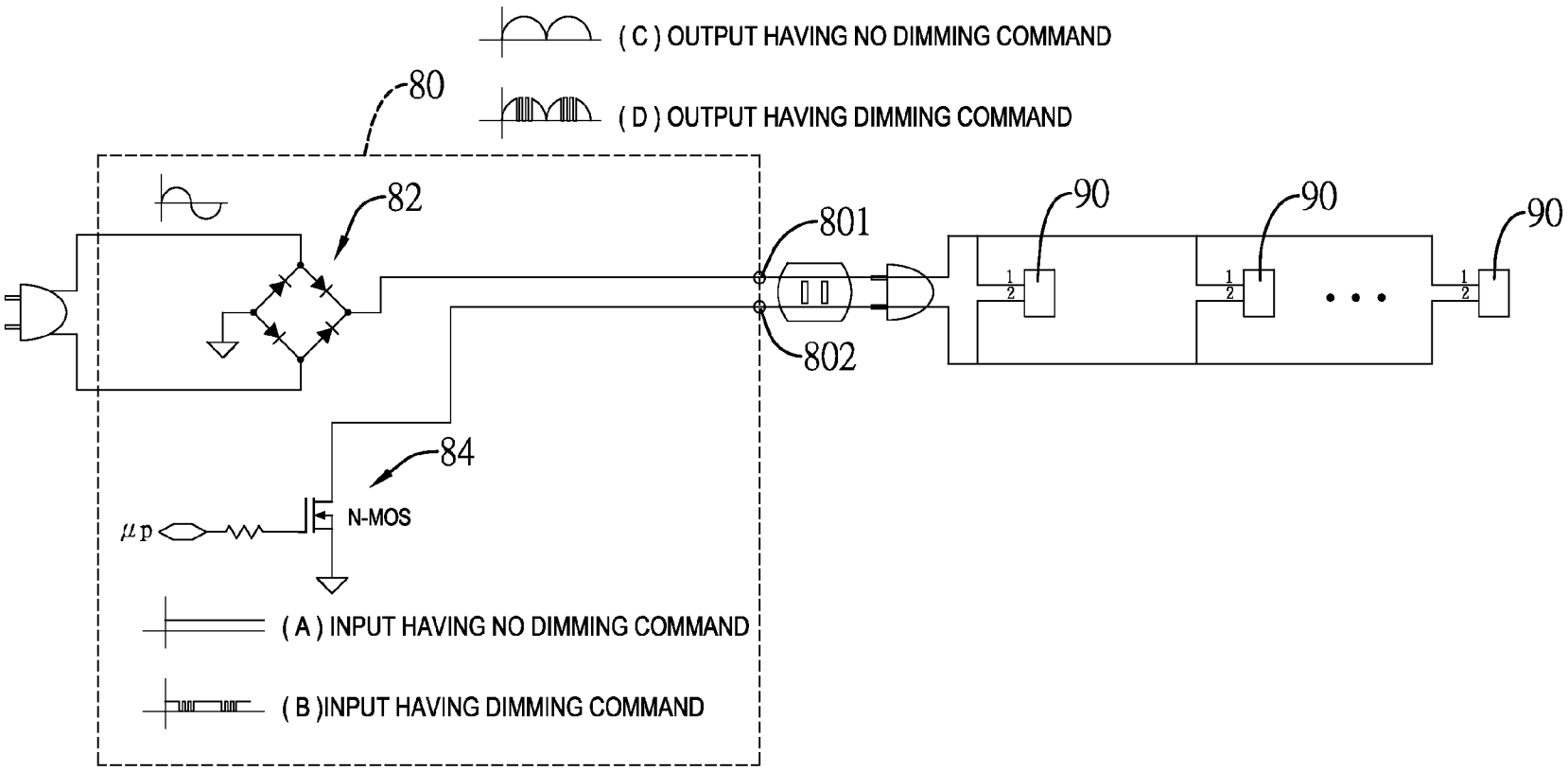
FIG.12 PRIOR ART
FIG. 12 is a circuit diagram of another conventional dimming controller connected with multiple lighting devices.
Figure 13:
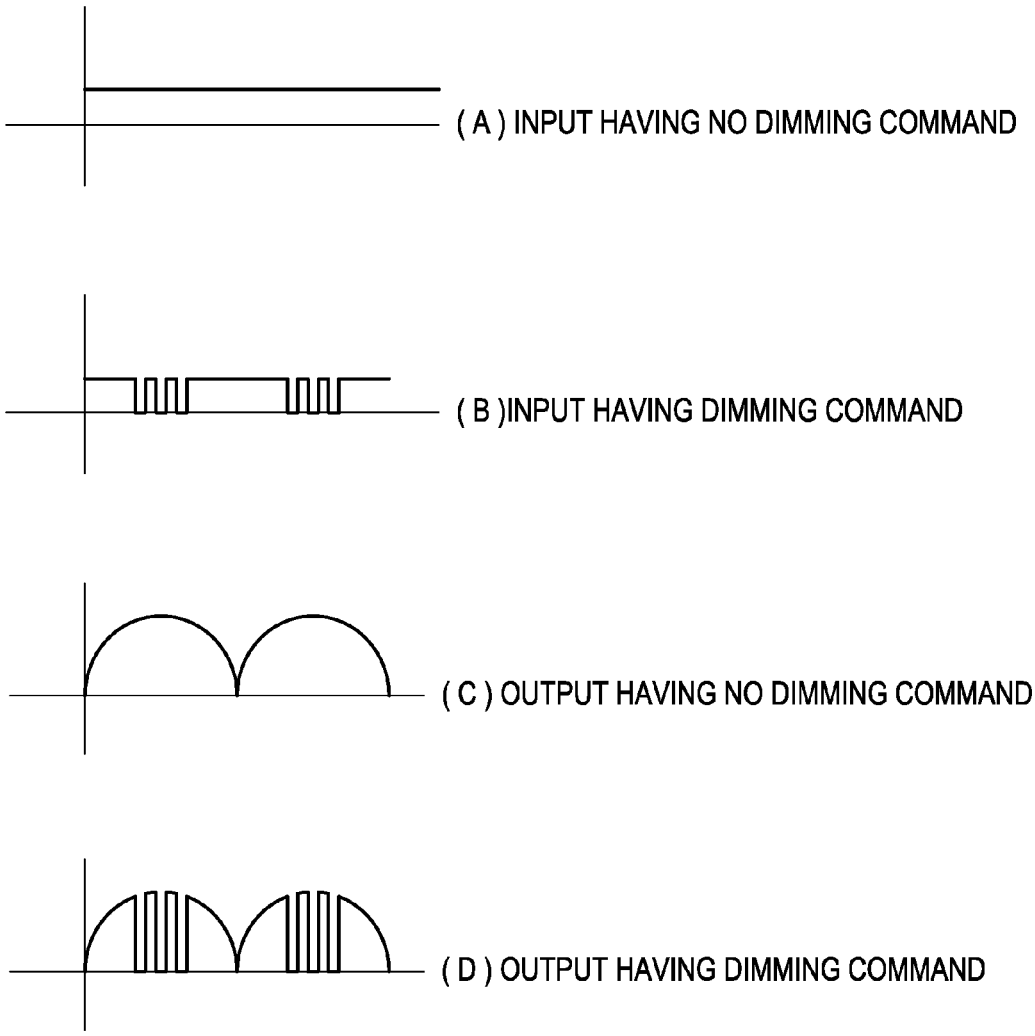
FIG.13 PRIOR ART
FIGS. 13(A)-13(D) are waveform diagrams corresponding to inputs and outputs of the circuit in FIG. 12.

With reference to FIG. 10, a method for transmitting power and dimming commands in accordance with the present invention is shown. The method is performed by a dimmer 1 having switchable power modes and multiple lighting devices 2 electrically connected therewith, and has the following steps.

Step 101: The dimmer 1 determines if receiving a user command to perform a dimming adjustment.

Step 102: If the dimmer 1 is not instructed to perform a dimming adjustment, the dimmer performs a bypass mode when an AC power is directly transmitted to the lighting devices 2 with the dimmer being bypassed.

Step 103: If the dimmer 1 is instructed to perform a dimming adjustment, the dimmer 1 performs a dimming mode when the dimmer 1 further performs steps of converting the AC power into a full-wave DC power, modulating the full-wave DC power by turning on and off the full-wave DC power according to pulses of a dimming command so as to generate a dimming output power having the pulses of the dimming command embedded therein, and transmitting the dimming output power to the lighting devices 2 for the lighting devices to decode the dimming command and receive a required power and performs the dimming adjustment according to the decoded dimming command.

In sum, the high power dimmer having switchable power modes of the present invention is appropriately switched in terms of its power modes by the output selector so that most of the time power is directly transmitted to the lighting device with the rectification circuit and the power switch in the dimmer being bypassed. As the rectification circuit and the power switch only perform circuit operation during the dimming mode and the time for the dimming operation is extremely short, the present invention is advantageous in low heat generation and its applicability to high power lighting devices.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A high power dimmer having switchable power modes comprising:

a power input terminal for receiving an AC power;

a rectification circuit connected to the power input terminal for rectifying the AC power under a dimming mode to generate an output power;

a dimming controller outputting a switching command and a dimming command under the dimming mode ;

a power switch being normally on and turned on and off according to the dimming command to convert the output power into a dimming output power having the dimming command embedded therein;

an output selector having:

a first input port connected to the power input terminal to receive the AC power;

a second input port connected to the power switch to receive the dimming output power; and an output port selectively connected to the first input port or the second input port according to the switching command generated by the dimming controller; and a power and signal output terminal connected to the output port of the output selector to output the AC power or the dimming output power.

2. The high power dimmer as claimed in claim 1, further comprising a voltage detector having an input terminal connected to an output terminal of the rectification circuit to compare voltage of the output power from the rectification circuit with a reference voltage and output a comparison result to the dimming controller.

3. The high power dimmer as claimed in claim 1, further comprising a signal detection receiver connected to the dimming controller and receiving an external dimming signal for the dimming controller to generate a corresponding dimming command according to the dimming signal.

4. The high power dimmer as claimed in claim 3, wherein the signal detection receiver is selected from one of IrDA (Infrared Data Association) infrared receiver, RF (Radio frequency) receiver, PIR (Passive infrared)-based motion sensor, audio receiver, RS485 receiver, DMX512 receiver, RS232 receiver, PLC (Power line communication) receiver, keyboard/keypad receiver and VR (Variable resistor) receiver.

5. The high power dimmer as claimed in claim 1, wherein the power switch has a switch therein selected from one of solid state relay, p-MOS FET, n-MOSFET, NPN transistor, PNP transistor, IGBT, SCR and TRIAC.

6. The high power dimmer as claimed in claim 1, wherein the power and signal output terminal and the power input terminal are selected from one of socket type, wire-out type and power terminal type connection interfaces.

7. The high power dimmer as claimed in claim 1, wherein the dimming command is a pulse train.

8. The high power dimmer as claimed in claim 7, wherein a format of the dimming command is selected from one of a UART (universal asynchronous receiver transmitter) format or a PTM (pulse time modulation) format.

9. The high power dimmer as claimed in claim 1, wherein when the dimming controller outputs the dimming command, the output port of the output selector is connected to the second input port according to the switching command, and after the dimming controller transmits the dimming command, the output port of the output selector is connected to the first input port according to the switching command.

10. A dimming system having switchable power modes comprising the high power dimmer as claimed in claim 1, and further comprising at least one lighting device, wherein each one of the at least one lighting device has:

at least one lighting unit; and a dimmable power source having:

a power and signal input terminal connected to the power and signal output terminal of the dimmer to receive the AC power or the dimming output power outputted from the dimmer;

a power supply receiving the AC power or the dimming output power through the power and signal input terminal to generate a DC power supplying the lighting device;

a light source driving circuit connected to the power supply to receive the DC power and further drive the at least one lighting unit to emit light;

a dimming decoder receiving the dimming output power through the power and signal input terminal, fetching a dimming signal portion in the dimming output power, and decoding the dimming signal portion to the original dimming command; and a control circuit generating a control signal according to the dimming command and sending the control signal to the light source driving circuit for the light source driving circuit to drive the lighting unit to present specific lighting variation.

11. The dimming system as claimed in claim 10, wherein each one of the at least one lighting unit is selected from one of a light-emitting diode (LED), an organic light-emitting diode (OLED) or a polymer light-emitting diode (PLED).

12. The dimming system as claimed in claim 10, wherein the power and signal input terminal is selected from one of bulb holder socket adapter, wire connector socket adapter, bi-pin base socket adapter and adapter types of E27, E12, E14, E17, E26, E39, E40, MR11, MR16, GU10, B22, T5, T8 and GU24.

13. The dimming system as claimed in claim 10, wherein the at least one lighting unit emits light having different wavelengths.

14. The dimming system as claimed in claim 10, wherein the control circuit has a flash memory for recording the lighting condition and an address of each one of the at least one lighting device.

15. The dimming system as claimed in claim 10, wherein the dimming command is a pulse train.

16. A dimming device comprising the high power dimmer as claimed in claim 1 and further comprising a dimmable power source, wherein the dimmable power source has:

a power and signal input terminal connected to the power and signal output terminal of the dimmer to receive the AC power or the dimming output power from the dimmer;

a power supply receiving the AC power or the dimming output power through the power and signal input terminal to generate a DC power supplying the lighting device;

a light source driving circuit connected to the power supply to receive the DC power and further drive the lighting unit;

a dimming decoder receiving the dimming output power through the power and signal input terminal, fetching a dimming signal portion in the dimming output power, and decoding the dimming signal portion to the original dimming command; and a control circuit generating a control signal according to the dimming command and sending the control signal to the light source driving circuit for the light source driving circuit to adjust a driving current.

17. The dimming device as claimed in claim 16, wherein the dimming command is a pulse train.

18. A method for transmitting power and dimming commands performed by a dimmer having switchable power modes and multiple lighting devices electrically connected therewith, and the method has the following steps:

the dimmer determining if receiving a user command to perform a dimming adjustment;

if the dimmer is not instructed to perform a dimming adjustment, the dimmer performing a bypass mode when an AC power is directly transmitted to the lighting devices with the dimmer being bypassed;

if the dimmer is instructed to perform a dimming adjustment, the dimmer performing a dimming mode when the dimmer further performs steps of:

converting the AC power into a full-wave DC power;

modulating the full-wave DC power by turning on and off the full-wave DC power according to pulses of a dimming command so as to generate a dimming output power having the pulses of the dimming command embedded therein; and transmitting the dimming output power to the lighting devices for the lighting devices to decode the dimming command and receive a required power and performing the dimming adjustment according to the decoded dimming command.

* * * * *